US005419275A

United States Patent [19]

Wood

[11] Patent Number: 5,419,275

[45] Date of Patent: May 30, 1995

[54] BATTEN REINFORCED ANCHORING BAG

[76] Inventor: Greg H. Wood, P.O. Box 1928, Soldotna, Ak. 99669

[21] Appl. No.: 984,898

[22] Filed: Dec. 2, 1992

[51] Int. Cl.[6] ..... B63B 21/48

[52] U.S. Cl. ..... 114/311

[58] Field of Search ..... 114/121, 122, 123, 124, 114/125, 294, 311

[56] References Cited

U.S. PATENT DOCUMENTS

| | | | |
|---|---|---|---|
| 300,764 | 6/1884 | Collins | 114/311 |
| 332,898 | 12/1885 | Hart | 114/311 |
| 2,785,646 | 3/1957 | Meyer | 114/311 |
| 3,064,613 | 11/1962 | Hubick | 114/311 |
| 3,459,151 | 8/1969 | Takeshi | 114/209 |
| 3,472,195 | 10/1969 | Takeshi | 114/209 |
| 4,481,900 | 11/1984 | Rutten et al. | 114/311 |
| 4,534,306 | 8/1985 | Rutten et al. | 114/311 |
| 4,632,051 | 12/1986 | Raymond et al. | 114/311 |
| 4,637,330 | 1/1987 | Shewmon | 114/311 |
| 4,733,628 | 3/1988 | Baughman | 114/311 |
| 4,766,837 | 8/1988 | Parish | 114/311 |
| 4,905,622 | 3/1990 | Silvia | 114/123 |
| 4,926,780 | 5/1990 | Wiehagen | 114/311 |
| 5,025,746 | 6/1991 | Boulter | 114/311 |

FOREIGN PATENT DOCUMENTS

| | | | |
|---|---|---|---|
| 1180 | 1/1890 | United Kingdom | 114/311 |
| 550546 | 1/1943 | United Kingdom | 114/311 |
| 244900 | 10/1969 | U.S.S.R. | 114/311 |

*Primary Examiner*—Stephen P. Avila

[57] ABSTRACT

A square bag (28) open at the top or front with holes (30) in the bottom or opposite end for drainage and flow through. Tow members (16) secured to the periphery of the bag (28) at the open end of the body in a hinging fashion so they can be neatly folded down in the bottom of the bag (28). The anchor rode (10) is secured to these tow members (16) and faked down into the bag (28). Battens (32B) and reinforcing material (20) are used to force the bag (28) to stand up in the open position facilitating ease of feeding rode (10) in and out of bag (28). Tow members (16) hinge outward and Batten Reinforced Anchoring Bag (35) becomes a sea anchor when thrown overboard. Holes (30) in bottom of bag let water flow through bag (28) somewhat slowed down, facilitating in bag (28) staying open and creating drag which is the object of the sea anchor. Through hole (26) in bottom of bag (28) is provided for tripline (36C) to haul Batten Reinforced Anchoring Bag (35) back to boat (33A) and provide, in conjuction with ring (12) at eyelet (14), a means for using two Batten Reinforced Anchoring Bags (35) at once as sea anchors.

2 Claims, 3 Drawing Sheets

BATTEN REINFORCED ANCHORING BAG

BACKGROUND—FIELD OF INVENTION

This invention relates to sea anchors and rode bags and is a combination of both.

BACKGROUND—DESCRIPTION OF PRIOR ART

Sea anchors are well known in the nautical arts. They serve many purposes including preventing a boat from drifting freely and by creating a drag just below the surface of the water, much like dragging a plow through the earth. This drag can be used to keep the bow of the boat facing the waves for safety. It can also slow down a boat that idles too fast, making it possible to troll. In addition, sea anchors are used with horseshoe buoys. When thrown overboard, they keep the wind from pushing the buoy faster than a person in the water can swim. In general, they are used as somewhat of an attachment point on the surface of the water. Unfortunately they are bulky, expensive, and hard to stow, especially on small boats which is probably why most small boats do not have them.

The anchor rode bag is used to store the anchor rode (line) in a neat faked down fashion, one coil on top of the other. Then, when the anchor is thrown overboard, the line comes out of the bag without tangling. It also protects the rode from ultra violet light and rust damage. Unfortunately, it is very difficult to feed the line into a limp bag, so many boaters use milk cartons, buckets or just fake the line down on deck, which can be hazardous.

In the past, the bottom anchor, sea anchor, chain and anchor line have been a stowage problem. This has resulted in many different anchoring systems and methods for stowing them most of which are too bulky for small boats.

OBJECTS AND ADVANTAGES

Accordingly, several objects and advantages of my invention are to eliminate a stowage problem. Eliminating the rode bag, bucket, or milk carton and replacing them with a batten reinforced bag that stands open on its own, makes it easy to fake down the rode, keeping it neat, protected, and free of tangles and ready to be used at a moments notice. The cloth bag is much nicer on board a boat and conforms to the many different spaces it may be put. Battens can be removed if necessary and put back even when the bag is full. The carrying handle makes the whole system easy to carry about.

This same bag is also a sea anchor that fastens to the bitter end of the rode, making both ends functional. Sea anchors are not normally used very often, and when needed, are apt to be in a hard to find and unattainable spot. Especially on small boats, sea anchors are apt to be left behind because they are bulky. My sea anchor is already on deck, serving as a rode bag. All that is necessary when needed is to dump out the rode and throw the bag overboard. On a boat, this is like stepping on the brakes of an automobile.

The Batten Reinforced Anchoring Bag (used as a sea anchor here) when in the water in this fashion, acts as a parachute does in the air, creating drag which can be used to slow down the boat or keep it pointed in a safer direction (bow into the waves). With the battens removed, the Batten Reinforced Anchoring Bag can be folded up in a very small bundle, making it an easily stowed sea anchor. In the event the battens are lost, it functions fine without them for that purpose.

Further objects and advantages of my invention will become apparent from a consideration of the drawings and ensuing description of it.

DRAWING FIGURES

Closely related figures have the same number but different alphabetic suffixes.

Reference Numerals In Drawings

| | | | |
|---|---|---|---|
| 8 | anchor | 9 | chain |
| 10A | working anchor rode | 10B | storm anchor rode |
| 12A | attachment ring | 12B | second ring |
| 14 | eyelet | 16 | straps |
| 17 | strap attachment loops | 18 | bag attachment loops |
| 20A | webbing reinforcement belts | 20B | mouth stiffener |
| 20C | center brace | 22 | handle grommet |
| 24 | handle | 26 | through hole |
| 28 | square flexible bag | 30 | triangular holes |
| 32A | batten pocket | 32B | battens |
| 33A | boat | 33B | motor |
| 33C | boater | 34 | sailboat |
| 35A | anchoring bag A | 36A | lanyard |
| 36B | float | 36C | tripline |

DESCRIPTION—FIGS. 1A to 3C

Figure 1A:
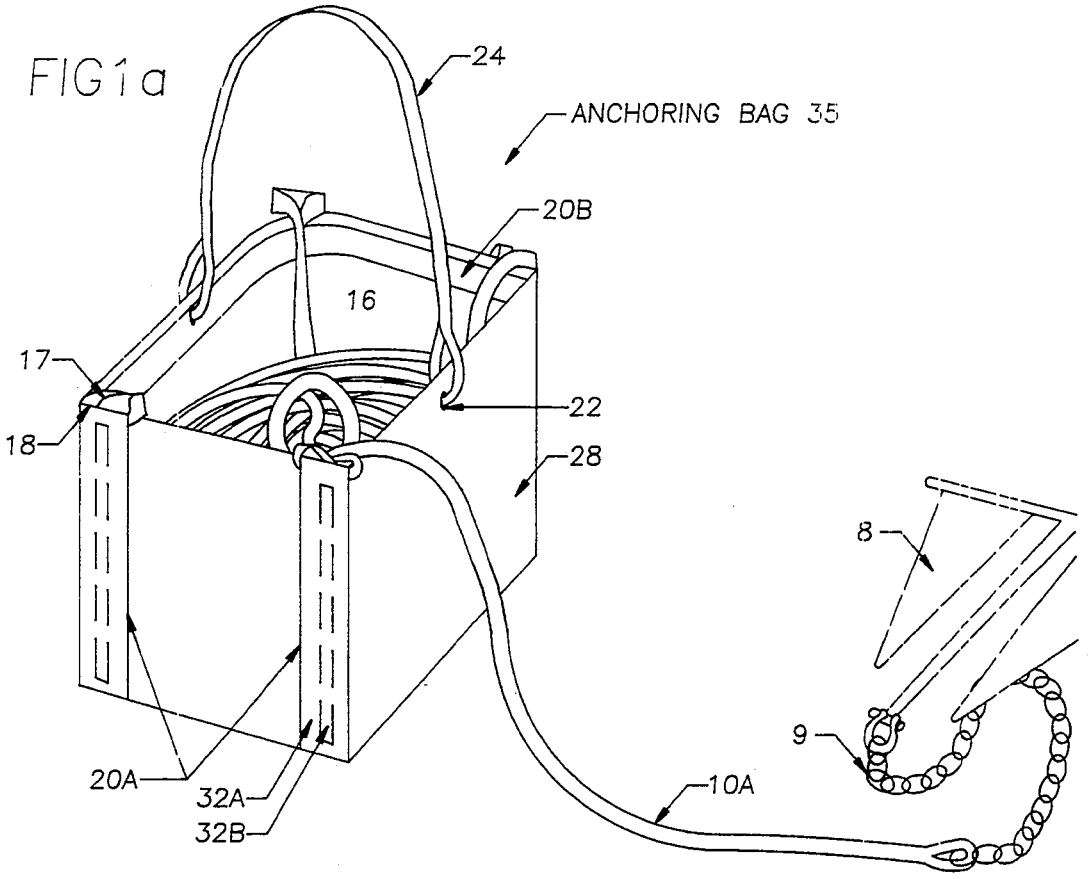
FIG. 1A shows the Batten Reinforced Anchoring Bag in position used to store and carry the rode.
Figure 2A:
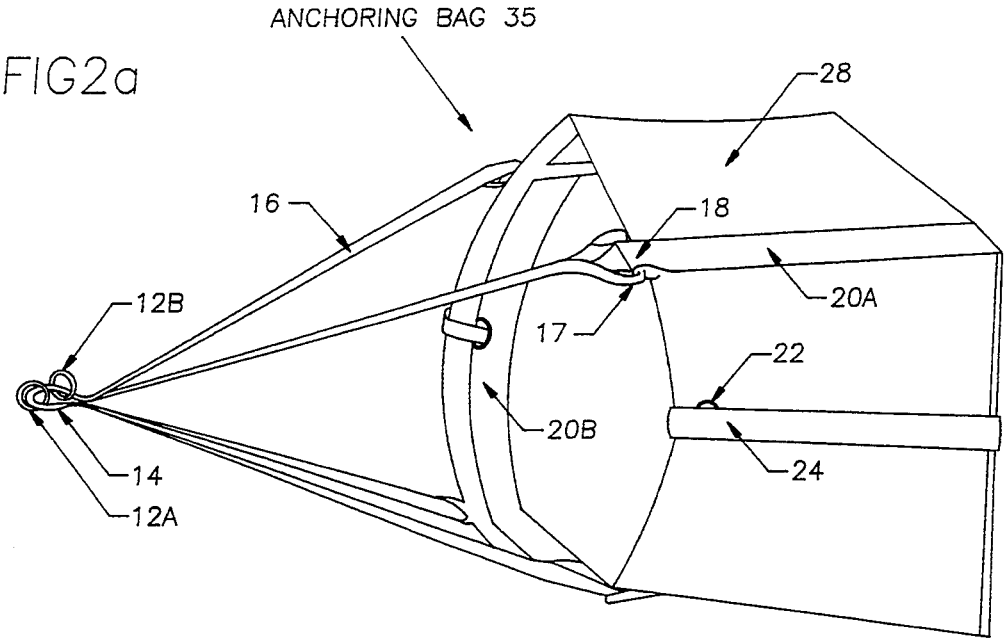
FIG. 2A shows the bag in the sea anchor mode.
Figure 3A:
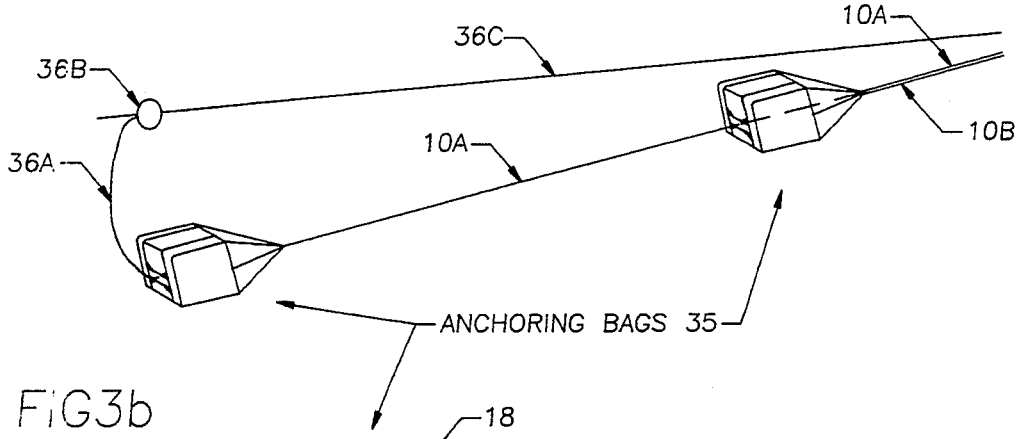
FIG. 3A shows two Batten Reinforced Anchoring Bags used at the same time to create more drag.
Figure 3B:
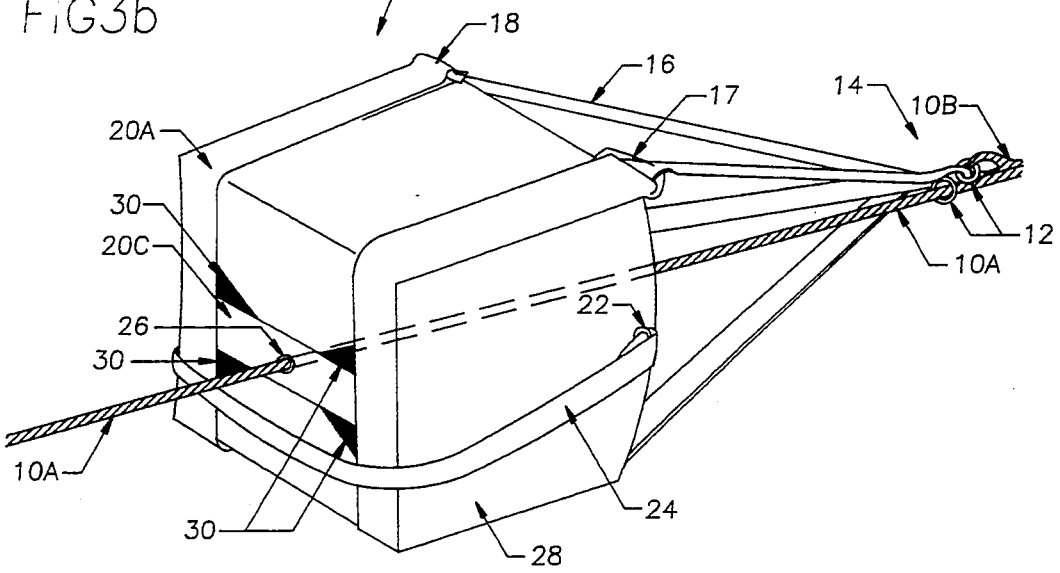
FIG. 3B shows this doubling method at a larger scale.

A typical embodiment of the multi-purpose bag of the present invention is illustrated in FIG. 1A (upright), FIG. 2A (side view), and FIG. 3B (bottom view). FIG. 1A shows my invention in rode bag form with carrying handle 24 (made of one inch heavy webbing and attached to the side of the bag with grommets 22) in upright position and eyelet assembly 10–16 (also made of one inch nylon webbing with two stainless steel round rings) buried in the bottom of the bag 28 by the full length of the anchor rode 10. Straps 16 can be seen as they form strap attachment loops 17 and connect with the main embodiment at the bag attachment loops 18. These attachment loops 17 and 18 form a hinge allowing the whole strap assembly 10–16 to fold neatly down in the bottom of the bag 28. The bag attachment loops 18 are made of two pieces of two inch heavy nylon webbing reinforcement belts 20A with their ends folded back and sewn to form the bag attachment loops 18. These two webbing belts 20A run down the same side of the square flexible bag 28 as best shown in FIG. 3B around the bottom and back up on the opposite side of the bag 28. Two other pieces of two inch webbing reinforcement are used and they are the bottom brace 20C as best shown in FIG. 3B which fastens the two attachment belts 20A together at their centers and the bag mouth stiffener 20B which runs the full circumference of the bag opening as best shown in FIGS. 1A and 2A. Further strengthening the whole bag and providing a strengthened center for the through hole 26. It will be noted here that when sewing the attachment belts to the sides of the bag, that they are not sewn perpendicularly across the top of the belt thus forming a batten pocket 32A for a one-half inch by eleven inch fiberglass batten 32B best shown in FIG. 1A as the battens 32B are the only broken lines in the drawing.

FIG. 2A shows my invention in its sea anchor form with rode 10, eyelet assembly 12–14 and straps 16 stretched out in front of the bag opening and the handle 24 folded out and around the bottom of the bag 28.

FIGS. 3A and 3B, best show the triangular holes in the bottom of the bag as well as the #4 spur grommet through hole in the center.

The bag itself could be made of any strong material such as cotton canvas, polyester, acrylic, nylon, etc. However, I prefer the polyester more specifically Destiny II obtained from the Astrup Company 2937 West 25th Street, Cleveland, Ohio 44113, because it holds up best to ultra violet, rust, abrasion, and is extremely strong.

Figure 2B:
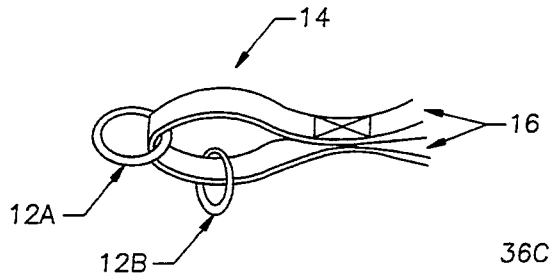
FIG. 2B is a close up of the eyelet.

In FIG. 2B, it can be seen that the four straps 16 are made of two pieces of one inch heavy webbing with eyes sewn in each end, forming strap attachment loops 17. These two straps are laid on top of each other, folded at their center and sewn together, after first running them through two stainless steel rings 12A–12B forming the eyelet 14 shown.

The dimensions of this bag are twelve inches by twelve inches square and twelve inches deep, and the tow straps 16 are two foot to the eyelet 14. It is my intention to make them in a variety of sizes and shapes to accommodate different size boats, conditions, and anchor systems.

From the description above, a number of advantages become evident:

(a) The bag stays open and stands upright making it easy to feed the anchor rode (line or rope) into the bag.

(b) The sea anchor being attached to the bitter end of the anchor rode puts both ends of the system to work, bottom anchor on one end and surface anchor on the other.

(c) The surface anchor being already attached in this fashion makes it much faster and easier to use.

(d) The Batten Reinforced Anchoring Bag being so convenient and easy to use means the anchor line is more apt to be kept out of the damaging ultra violet light rays and therefore is much stronger and more stretchable as desired.

(e) For boats that already have a good anchoring system, the battens can be removed making the Batten Reinforced Anchoring Bag a very easily stowed sea anchor taking up very little space.

OPERATION—FIGS. 1A to 3C

The manner of using the Batten Reinforced Anchoring Bag (a combination of rode bag and sea anchor) is much easier than prior rode bags and sea anchors as will be outlined in the following paragraphs.

Figure 1B:
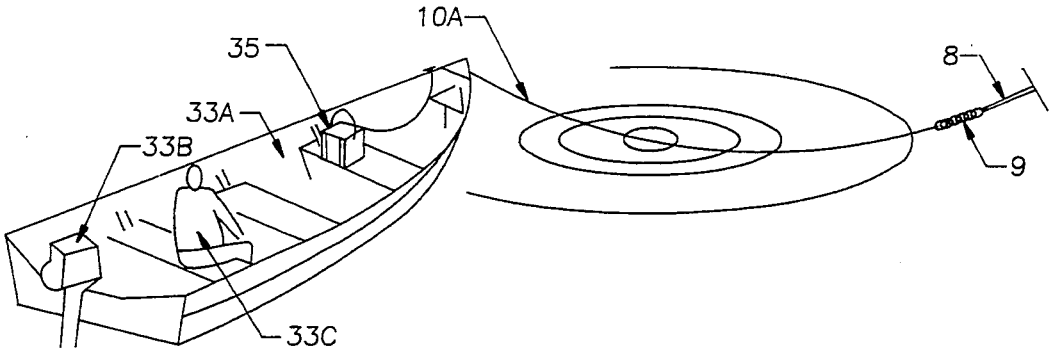
FIG. 1B shows the Batten Reinforced Anchoring Bag in use as a rode bag.

In the case of the rode bag, FIG. 1A the bitter end of the rode 10 is attached to the attachment ring 12 of the Batten Reinforced Anchoring Bag. It will be noted that the anchor rode 10 is not part of the present invention, but is a part of the equipment already on board a given boat which attaches to the attachment ring 12 of the present invention, The anchor rode 10 is then fed into the bag 28 one coil on top of another in a faked down manner until only the chain 9 is left. The chain 9 should not be stored in the bag 28, unless shielded from the rode, as rust can weaken nylon line. FIG. 1A shows the anchor system in this ready to go fashion. When the anchor 8 is thrown overboard, the rode 10 comes out of the bag just like it was put in, one coil at a time without getting tangled. FIG. 1B shows a boat 33A and boater 33C with bottom anchor 8 and Batten Reinforced Anchoring Bag being used as a rode bag.

FIG. 1A also shows the sea anchor in a ready to go fashion. All one needs to do is dump the rode 10 out on deck or in the bottom of the boat 33A and throw the sea anchor (Batten Reinforced Anchoring Bag) overboard. When the proper amount of rode 10 is let out, it is cleated and the remainder coiled by hand or put out of the way as best shown in FIG. 2C.

The through hole 26 in the bottom of Batten Reinforced Anchoring Bag is provided for a number of reasons:

(a) To provide an attachment point for a lanyard 36A. This lanyard 36A, can be used to fasten the Batten Reinforced Anchoring bag to the boat, so the anchor 8 cannot pull the whole system overboard. The lanyard 36A can be flemished down in the bottom of the bag 28 with rode 10 faked down on top.

Figure 2C:
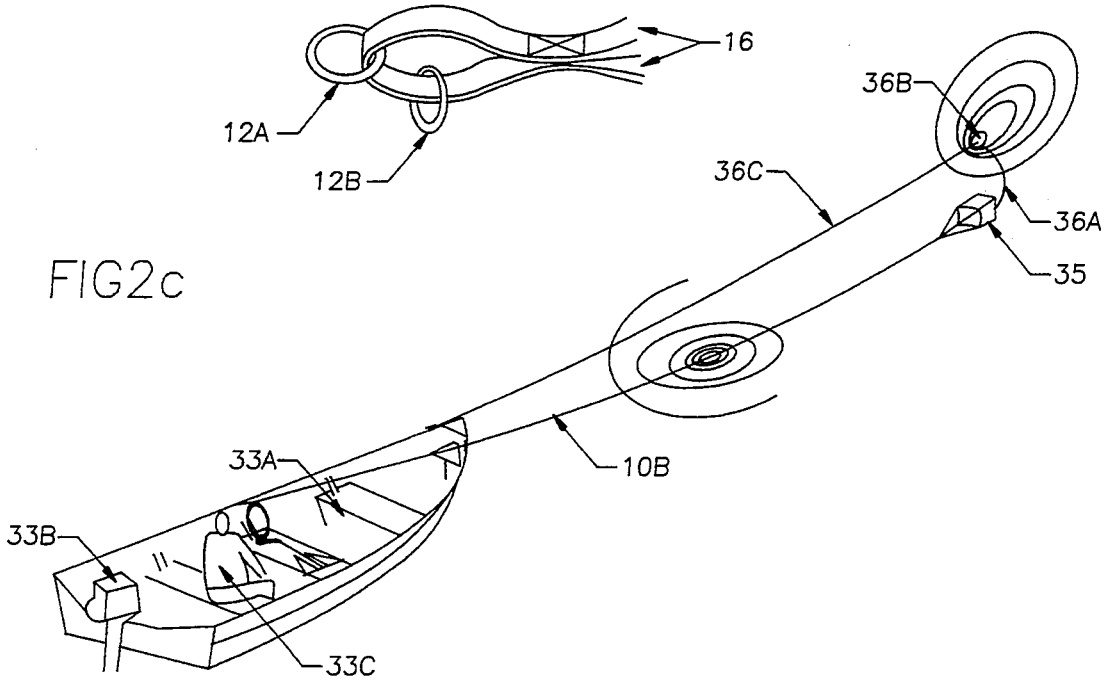
FIG. 2C shows the Batten Reinforced Anchoring Bag in use as a sea anchor

(b) To fasten to a small float 36B and tripline 36C as shown in FIGS. 2C and 3A to float Batten Reinforced Anchoring Bag if necessary and to facilitate pulling it back to the boat 33A backwards.

Figure 3C:
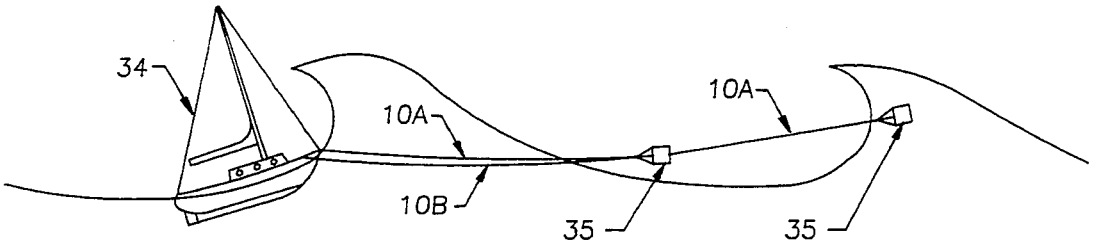
FIG. 3C shows this doubling method in use on a cruising sailboat in large waves.

(c) To facilitate multiple Batten Reinforced Anchoring Bags (sea anchors) used at the same time when one is not enough, as shown in FIGS. 3A, 3B, and 3C. Under severe conditions as shown in FIG. 3C, it becomes apparent why multiple Batten Reinforced Anchoring Bags and different sizes as well are desirable on board a cruising sailboat.

Most cruising boats have two or three anchoring systems. These systems vary in size and length. For example, a working anchor is the system most used, and is a medium size anchor with medium size and length rode and, would use a medium size Batten Reinforced Anchoring Bag. The storm anchor on board is usually a very large, heavy anchor with a large diameter as well as long length rode and probably would not fit in a medium bag and a larger Batten Reinforced Anchoring Bag would be necessary. Also under storm conditions, the larger Batten Reinforced Anchoring Bag (sea anchor) as well as maybe two Batten Reinforced Anchoring Bags would be appropriate.

These rode bag and sea anchor combination Batten Reinforced Anchoring Bags can be built quite inexpensively and would cost little more than a rode bag or sea anchor already on the market, and much less than purchasing one of each.

The novel feature being the combination of both, sea anchor and rode bag, and putting both ends of the anchor rode to use, with both type anchors (bottom and surface) on either end.

My Batten Reinforced Anchoring Bag could just as easily be called a boating, yachting, rigging, or cruising bag, etc. for many purposes, some of which are listed below.

(a) The anchor rode can be disconnected and the Batten Reinforced Anchoring Bag can be used as a tote bag with a carrying handle.

(b) The Batten Reinforced Anchoring Bag can be lifted with the eyelet, much like a landing net or brailing bag.
(c) The Batten Reinforced Anchoring Bag can be hauled a loft by the eyelet as a rigging bag.
(d) The Batten Reinforced Anchoring Bag can be lined with a rubber insert and a hose fed through the through hole to haul water a loft for a shower.
(e) The Batten Reinforced Anchoring Bag can be weighted and put off the side of the boat as a motion dampener.
(f) The triangular holes in the bottom of the Batten Reinforced Anchoring Bag can be closed off one at a time creating an adjustable drag.

SUMMARY, RAMIFICATIONS, AND SCOPE

Accordingly, the reader will see that the combination Batten Reinforced Anchoring Bag of this invention can be used to easily and conveniently store, carry, protect, and deploy the anchor rode (line). In addition, the bag itself is a surface type sea anchor and with bitter end of anchor rode already attached, need only to be thrown overboard to be deployed. Furthermore, the Batten Reinforced Anchoring Bag has the additional advantages in that it can be used as an everyday tote bag;
it can be used in conjunction with another Batten Reinforced Anchoring bag, creating much more drag;
it can be used as a lifting and hauling device;
it can be used to stabilize a boat in a seaway and;
it is sturdy enough to haul water a loft for a shower.

Although the description above contains many specificities, these should not be construed as limiting the scope of the invention, but as merely providing illustrations of some of the presently preferred embodiments of this invention. For example, the Batten Reinforced Anchoring Bag can have other shapes, such as cylindrical, radial, tubular, or any hollow shape with a somewhat closed bottom. It can be many different colors and it can be made of many different fabrics, ropes, tapes, webbings, etc.; it can have grommets for holes in the bottom or mesh, actually any form of hole would work; it can be made with or without battens etc.

Thus, the scope of the invention should be determined by the appending claims and their legal equivalence, rather than be the examples given.

I claim:

1. The combination of a sea anchor and a rode bag comprising:

a bag formed of flexible vertical side panels and a flexible horizontal bottom panel, the side panels defining a shape, said shape at its widest portion having a cross-sectional area, the bottom panel having a cross-sectional area substantially the same as said cross-sectional area of the widest portion of the shape;

said bag further including supporting means including strong, sufficiently rigid material attached to the sides of the bag to assist the bag in standing upright and open to facilitate feeding of an anchor line within and carrying means to facilitate use as a rode bag;

said bag further having anchor line attachment means to attach an anchor line to the bag to facilitate use as a sea anchor.

2. The combination of claim 1, wherein said supporting means further includes the use of removable battens inserted between the strong material and the sides.

* * * * *